US005152197A

United States Patent [19]

Szymber et al.

[11] Patent Number: 5,152,197

[45] Date of Patent: Oct. 6, 1992

[54] TOOTHLESS RATCHET AND CLUTCH MECHANISMS

[75] Inventors: Oleg Szymber, Arlington Heights, Ill.; Eustathios Vassiliou, Newark, Del.

[73] Assignee: Patcore, Incorporated, Newark, Del.

[21] Appl. No.: 715,978

[22] Filed: Jun. 17, 1991

[51] Int. Cl.[5] ..... B25B 13/00

[52] U.S. Cl. ..... 81/59.1; 192/44

[58] Field of Search ..... 81/59.1, 60, 63.1; 192/43, 44, 45, 48.1

[56] References Cited

U.S. PATENT DOCUMENTS

| | | | |
|---|---|---|---|
| 2,997,148 | 8/1961 | Linsley | 192/44 |
| 3,640,158 | 2/1972 | Myers | 81/59.1 X |
| 3,823,625 | 7/1974 | Myers | 81/59.1 |
| 4,441,387 | 4/1984 | Hendricks | 81/61 |
| 4,524,652 | 6/1985 | Wenzel et al. | 81/63 |
| 4,939,961 | 7/1990 | Lee | 81/60 |

*Primary Examiner*—James G. Smith

*Attorney, Agent, or Firm*—E. Vassiliou

[57] ABSTRACT

Toothless ratchet and clutch mechanisms characterized by substantially continuous engagement of the rachet wheel, thus allowing the mechanism to operate even under very limited-space conditions.

20 Claims, 2 Drawing Sheets

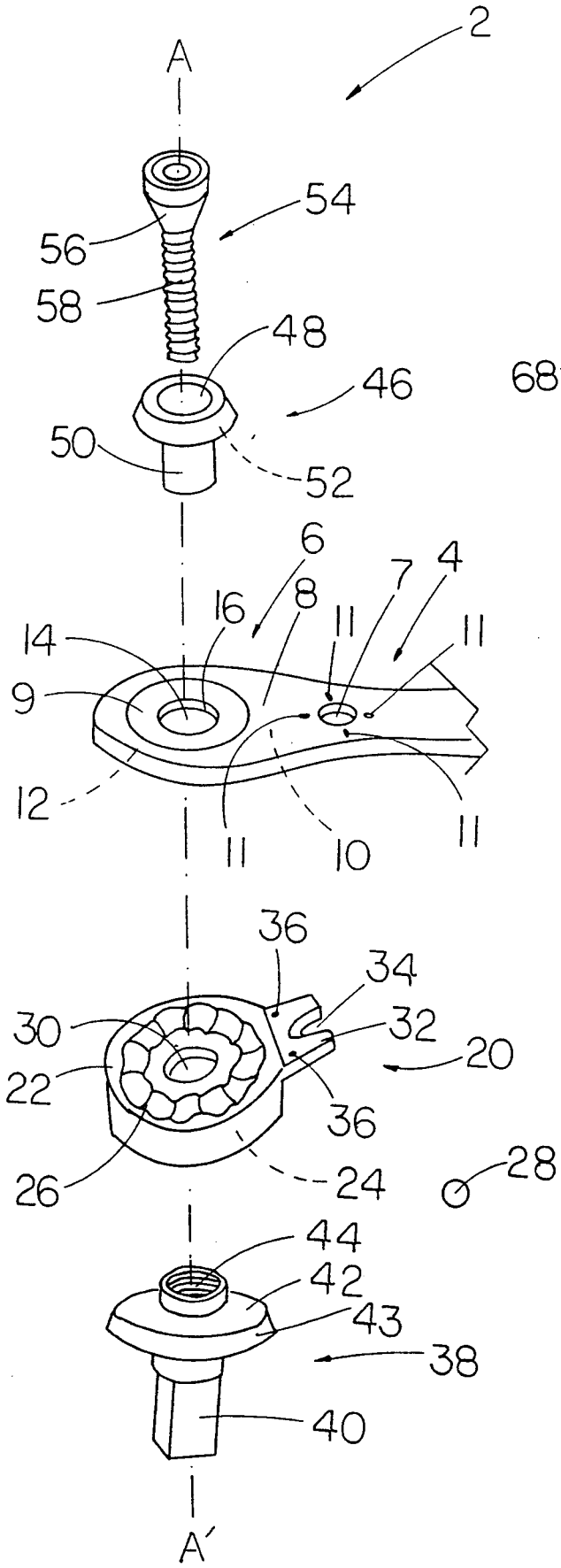
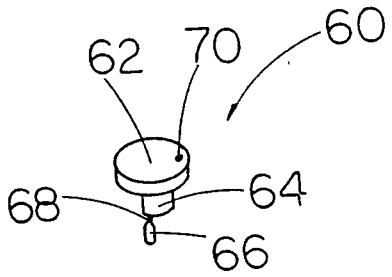
FIG. 1b
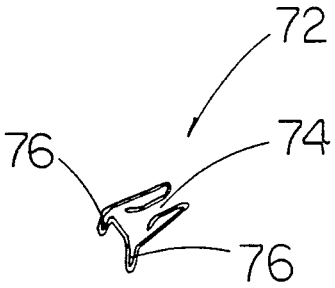
FIG. 1c
FIG. 1a

TOOTHLESS RATCHET AND CLUTCH MECHANISMS

FIELD OF THE INVENTION

This invention relates to ratchets and clutch mechanisms, and more particularly to a toothless ratchet.

BACKGROUND OF THE INVENTION

Ratchet mechanisms typically involve wheels or bars having inclined teeth, in which a pawl drops so that motion can be imparted to the wheel or bar, governed, or prevented. Rachet mechanisms are usually employed in hand tools of different kinds, such as wrenches, screwdrivers, and the like, in order to allow effective motion in one direction and prevent motion in the opposite direction.

Examples of tools using rachet mechanisms are given by U.S. Pat. No. 4,441,387 (Hendricks), and U.S. Pat. No. 4,524,652 (Wenzel et al.), among many others.

A large number of greatly diversified applications utilize also ratchet mechanisms in cases where effective unidirectional motion is needed. These applications may include drastically different end-uses, such as for example sailing winches, dental floss disposers, seat belt retractors, security entry systems, spinning reels, control manifolds, reclining mechanisms, labelers, mop connectors, faucet valves, exercise devices, printing apparatuses, cable hoists, and kite reels, to mention a few.

One of the biggest disadvantages of conventional ratchet mechanisms is that for the pawl to move from one tooth and engage the next tooth, the handle has to turn by an angle of typically 15–20 degrees. In addition, since the teeth are inclined, the backward motion required to engage a tooth starting from the preceding tooth is larger than the effective forward motion to turn the ratchet wheel, and thus additional "dead" space is needed. If there is no adequate space for such a manipulation the operation of using the ratchet cannot be performed. With the continuing trend to produce more and more compact cars, the open space under the hood of modern cars is becoming increasingly limited, and thus effective tools capable of operating in limited space are very desirable and many times absolutely necessary.

None of the above references discloses, suggests or implies the use of a mechanism comprising the elements of the present invention, as described in detail hereinafter.

SUMMARY OF THE INVENTION

The present invention pertains to a toothless ratchet tool, or a stepless socket driver comprising in combination an assembly of:

a handle ending to a head, the head having an upper side and a lower side opposite the upper side,
  the lower side comprising a first set of augmented semi-cells disposed around a center axis passing through a central point of the head, and being perpendicular to the lower and upper sides;

an activator disposed toward the lower side of the head and pivoted around the center axis, the activator having a cell side and a first conical frictional side opposite the cell-side,
  the cell side comprising a second set of augmented semi-cells commensurate to the first set of augmented semi-cells of the lower side of the head, thus forming pairs of augmented semi-cells;

a plurality of bearing balls, one ball contained in and co-acting with each pair of semi-cells;

a driver being turnable around the center axis and disposed under the activator in a manner to place the activator between the driver and the head of the handle, the driver having a socket driving side and a second conical frictional side commensurate to and adaptable to engage with the first conical frictional side; and means for rotatably connecting the driver and the head of the handle, and at such distance from each other, that when the augmented semi-cells of each pair are caused to be displaced with respect to each other, the activator is pushed toward the driver causing the first and the second frictional surfaces to firmly engage and lock the driver in one direction with respect to the handle.

This invention, also pertains to clutch or brake mechanism comprising in combination an assembly of:

a base having a head, the head having an upper side and a lower side opposite the upper side,
  the lower side comprising a first set of augmented semi-cells disposed around a center axis passing through a central point of the head, and being perpendicular to the lower and upper sides;

an activator disposed toward the lower side of the head and pivoted around the center axis, the activator having a cell side and a first conical frictional side opposite the cell-side,
  the cell side comprising a second set of augmented semi-cells commensurate to the first set of augmented semi-cells of the lower side of the head, thus forming pairs of augmented semi-cells;

a plurality of bearing balls, one ball contained in and co-acting with each pair of semi-cells;

a driver being turnable around the center axis and disposed under the activator in a manner to place the activator between the driver and the head of the base, the driver having a driving side and a second conical frictional side commensurate to and adaptable to engage with the first conical frictional side; and means for rotatably connecting the driver and the head of the base, and at such distance from each other, that when the augmented semi-cells of each pair are caused to be displaced with respect to each other, the activator is pushed toward the driver causing the first and the second frictional surfaces to firmly engage and lock the driver in one direction with respect to the base.

In addition, this invention pertains to a clutch mechanism as described above, further comprising biasing means for displacing each pair of the augmented semi-cells with respect to each other as described below, and also further comprising pulsating means pivotally connected to the base for providing oscillatory motion to the base, the oscillatory motion characterized by an oscillation angle having an effective value to translate the oscillatory motion of the base to rotational motion on the driver. Preferably, the oscillatory angle has a value in the range of 0.5–10 degrees.

Further, the present invention relates to a clutch mechanism as defined above, further comprising a socket supported on the base, the socket having a cavity of the type which can accept and engage with a socket driving stem, the socket having the center axis as an axis of symmetry.

Preferably, one or a combination of the following conditions may be utilized in the practice of this invention, in conjunction with one or more of the above requirements:

- the augmented semi-cells are equidistantly disposed from the center axis and also equidistantly disposed from each other;
- the means for rotatably connecting the driver and the head of the handle or the base comprise a ball bearing formed between an extension of the driver and the upper side of the head;
- the first conical frictional side comprises a configuration corresponding to the inside surface of a cone, and the second conical frictional side comprises a configuration corresponding to the outside surface of a cone;
- the first conical frictional side and the second conical frictional side exhibit a cone angle in the range of 10–40 degrees;
- the toothless rachet or the clutch mechanisms further comprise means for biasing the augmented semi-cells of each pair in a position causing the tool to follow a condition selected from the group consisting of locking the base with respect to the driver in one direction, locking the base with respect to the driver in an opposite direction, locking the base with respect to the driver in both directions, maintaining the base unlocked with respect to the driver in both direction, and a combination thereof.
- the means for selectively biasing the augmented semi-cells comprise a spring.

BRIEF DESCRIPTION OF THE DRAWING

The present invention will be best understood from the following description taken together with the accompanying drawing in which:

FIGS. 1*a*, 1*b*, and 1*c* illustrate a perspective view of the parts of a disassembled ratchet tool according to a preferred embodiment of this invention.

DETAILED DESCRIPTION OF THE INVENTION

Figure 2A:
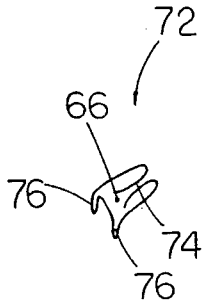
FIGS. 2*a*, 2*b*, 2*c*, and 2*d* show different biasing conditions of the spring generated by the thin stalk.
Figure 2B:
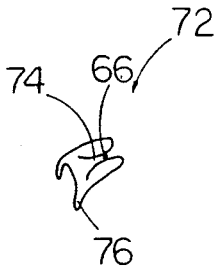

In a preferred embodiment of this invention, the clutch mechanism is in the form of a toothless ratchet tool, or a stepless socket driver.

Referring now to FIGS. 1–5, there is depicted a toothless ratchet tool or a stepless socket driver 2 comprising in combination an assembly of elements as indicated below. The major part of the tool 2 may be preferably made of metal, more preferably steel, and even more preferably hardened steel. However, any other materials of construction, such as for example plastics, reinforced plastics, and the like, are not excluded, and depending on the application they may be used exclusively or in combination with other fabrication materials. Any method of fabrication may be used, such as for example machining, forging, powder sintering and metallurgy, casting, molding, and the like, depending on the fabrication characteristics of the materials used, the accuracy required, the expense permitted for the particular application, and the like, as well as combinations thereof.

The tool 2 comprises a handle 4, which ends to a head 6. The handle 4 may have any type of cross section which is suitable for a handle, such as for example square, round, polygonal, and the like, as well as combinations thereof. Certain portions of the handle may be knurled for better grasp of the tool. The head 6 has an upper side 8 and a lower side 10, opposite the upper side 8. Preferably, the sides 8 and 10 are substantially parallel to each other and in general flat, except for certain cavities they may possess. The head 6 has also a perforation 7 and indentations 11 near the border where it extends to the rest of the handle 4.

The upper side 8 preferably comprises a first circular groove 9, which constitutes one of two cavities needed to accept bearing balls for forming a ball bearing. The first circular groove 9, is symmetrically disposed around a center axis A–A'.

Figure 5:
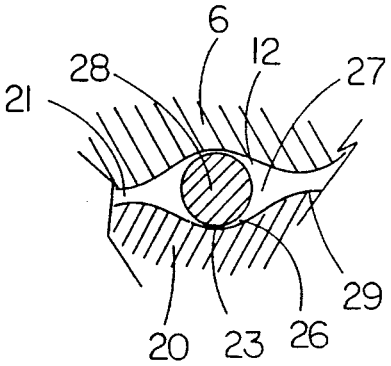
FIG. 5 illustrates an unfolded cross section of a full augmented cell comprising of two matching augmented semi-cells according to this invention.

The lower side 10 comprises a first set of augmented semi-cells 12, better shown in FIG. 5, disposed around the center axis A–A', which axis passes through a central point 14 of the head 6 and is substantially perpendicular to the lower side 8 and upper side 10. Preferably, the augmented semi-cells 12 are equidistantly disposed from the center axis A–A', and also equidistantly disposed from each other. By the word "augmented" it is meant that the semi-cells have been elongated mainly in one direction. Since it is preferable for the semi-cells to be equidistant from the axis A–A', they are located along the circumference of a circle. Unfolding this circumference into a linear configuration gives a better image of the structure of the semi-cell. Thus, the word "unfolded" signifies that a curved section, such as a circular section for example, has been unfolded into a linear two dimensional view for better understanding. FIG. 5 illustrates a cross section of an augmented unfolded semi-cell 12 matched with the cross section of another unfolded semi-cell 26 belonging to a different element, as it will be described hereinbelow, to form a pair of semi-cells or a full cell 27. The unfolded cross section shown in FIG. 5 is substantially perpendicular to the cross section shown in FIG. 3. It is preferable that the first set of augmented semi-cells contains at least three semi-cells, and even more preferably it contains more than three semi-cells. As aforementioned, it is also preferable that the semi-cells are arranged on the circumference of a circle. Depending on the intended use of the tool, more than one circles with semi-cells, or randomly arranged semi-cells may constitute the first set of augmented semi-cells 12.

Preferably, the head 6 has also a first center bore 16, which is preferably circular and has as center the central point 14.

The tool also comprises an activator 20, which is disposed toward the lower side 10 of the head 6. The activator 20 is pivoted around the center axis A–A'. It has a cell side 22 and a first conical frictional side 24 opposite the cell-side 22. The first frictional side 24 contains a first frictional surface 25, and is characterized by a first cone angle 31, preferably between 10 and 40 degrees, and more preferably between 15 and 25 degrees. The first conical frictional side 24 is preferably in the form of a cavity corresponding to the inside surface of a cone, usually to the inside surface of part of a cone.

The cell side 22 comprises a second set of augmented semi-cells 26 commensurate to the first set of augmented semi-cells 12 of the lower side 10 of the head 6, thus forming pairs of augmented semi-cells, or full cells 27, better illustrated in FIG. 5. The second set of augmented semi-cells 26 is preferably a mirror image of the first set of augmented semi-cells 12. In this particular example, there are twelve semi-cells per augmented semi-cell set, as better shown in FIG. 1*a* (due to the perspective view shown in the figure, only the set of the activator may be seen). In assembling the tool 2, a bearing ball 28 is preferably placed in each pair of augmented cell, and co-acts with the two respective semi-cells. Thus, a first set of bearing balls 28 is used to fill the full cells 27. The activator 20 has a second center bore 30. Preferably, the axis A–A′ passes also through the center of the second bore 30. The activator has also a guide 32 with an elongated slot 34, and two small holes 36.

The tool 2, further comprises a driver 38, which is turnable around the center axis A–A′ and is disposed under the activator 20, in a manner to place the activator 20 between the driver 38 and the head 6 of the handle 4. The driver 38 has a socket driving stem 40, and a second conical frictional side 42 comprising a second frictional surface 43. The second conical frictional side is commensurate to and adaptable to engage with the first conical frictional side 24 through the first and the second frictional surfaces 25 and 43, respectively. The second conical side has a second cone angle, which is substantially the same as the first cone angle. The second conical frictional side 42 preferably has the configuration of the outside surface of a cone, usually the outside surface of part of a cone. More than one pair of such frictional surfaces, preferably concentric, may be present. In the middle of the second conical frictional side 42, there is a threaded bore 44, as an integral part of the driver 38.

In this preferred embodiment, the tool 2 also utilizes a restrictor 46, which has a (V-shaped bore 48) and a sleeve 50. The axis A–A′ passes also through the center of the V-shaped bore 48, and it is an axis of symmetry to the sleeve 50. The restrictor has a second circular groove 52 commensurate and substantially identical to the first circular groove 9. The second circular groove 52 is concentric with the V-shaped bore 48 and the sleeve 50. The first and second circular grooves are matched upon assembling the tool and accept a second set of bearing balls 53. Preferably the bearing balls 53 of the second set are substantially identical to the bearing balls 28 of the first set.

In addition, the tool 2 utilizes a bolt 54 having a V-shaped head 56, commensurate to the V-shaped bore 48. The bolt 54 has also a threaded body 58 commensurate to the threaded bore 44 of the driver 38. Of course instead of using a bolt, other arrangements may be made, such as for example using a relatively long stem (not shown) in place of the threaded bore 44 on the driver 38, which long stem after passing through bores 30, 16 and 48 may be swaged or riveted on top of the restrictor 46.

As it will better be seen later, the bolt 54 along with the restrictor 46 and the ball bearing produced between grooves 9 and 52 containing the second set of bearing balls 53, may be considered as an extension of the driver 38, and constitutes means for rotatably connecting the driver 38 and the head 6 of the handle 4. By "rotatably connecting" it is meant that in the absence of other movement-restricting elements, and as far as the ball bearing produced between grooves 9 and 52 is concerned, the driver 38 is free to rotate around axis A–A′ with respect to the handle 4.

The bolt/restrictor/ball-bearing combination are arranged in a way to restrict the maximum distance between the head 6 and the activator so that when the head 6 is caused to turn with respect to the activator the augmented semi-cells 12 and 26 of each pair 27 are caused to be displaced with respect to each other, pushing the activator 20 toward the driver 38, which in turn causes the first and the second frictional surfaces 25 and 43, respectively, to firmly engage and lock the driver 38 to the activator 20; and the displacement of the augmented semi-cells 12 and 26 causes jamming of the semi-cells 12 and 26 with respect to each other, thus locking the activator 20 to the head 6, which has as a final result the locking of the head 6, and therefore the handle 4, with respect to the driver 38 through the activator 20.

In order to better control the direction at which the tool 2 will drive a socket, it is important to bias the activator 20 with respect to the head 6 in a way to cause displacement of the augmented semi-cells 12 and 26 with respect to each other in one direction or the opposite direction, which in both cases causes the first and the second surfaces 25 and 43 to come in contact with each other, and allows movement in one direction but prevents movement in the opposite direction. When the activator 20 is biased against any displacement of the augmented semi-cells 12 and 26 with respect to each other, free movement of the driver is allowed in both directions. In the absence of biasing altogether, the tool behaves as locked in both directions.

In the example of this particular embodiment, two additional elements may be used to achieve this.

One additional element is a selector 60, better shown in FIG. 1*b*, having on one side a knob 62 for allowing an operator to rotate the selector 60, and a short shaft 64 having a diameter commensurate to the diameter of the perforation 7. The short shaft 64 has a thin stalk 66 connected to it in the vicinity of its perimeter away from the knob 62. The thin stalk 66 has a reduced diameter sector 68 at the point where it meets with the short shaft 64. The knob 62 has preferably a visual indicator 70, which is preferably in a diametrically opposite position with respect to the position of the thin stalk 66. The length of the short shaft 64 is preferably substantially equal to the thickness of the head 6.

A second additional element is a bent wire spring 72, better shown in FIG. 1*c*, having a biasing portion 74 and two fastening bends 76, the distance between the bends being equal to the distance between the two small holes 36 of the guide 32.

The ramp or rise of each augmented semi-cell from a low point 23 toward a high point 29 per degree of circumferencial displacement around the axis A–A′ should be coordinated with the angle 31 and 45, and the coefficient of friction of the frictional surfaces 25 and 43 so that the torque at the handle 4 is smaller than the frictional torque produced by the frictional surfaces 25 and 43, when the tool is in a locking position. Typical values for this rise are 0.005–0.010 inch per degree of circumferencial displacement around the axis A–A′, for steel surfaces having an angle 31 and 45 of about 15 degrees, and using bearing balls having a diameter of 3/16 inch.

Assembling the tool 2 may be performed in a number of different ways. One of the preferred ways is described below, since it gives better insight to the operation of the tool.

First, the fastening bends 76 of the bent wire spring 72 are snapped in the small holes 36 of the activator 20, in a manner that the biasing portion 74 is positioned on top of the elongated slot 34. Also, the short shaft 64 of the selector 60 is inserted in the perforation 7 of the handle 4, in a manner that the indicator 70 is directed away from the head 6, and the short stalk 66 points toward the head 6. In this position, a small spring (not shown) under the knob 62 and supported by the knob 62 snaps temporarily into one of the four indentations 11. Also, in this position, the thin stalk 66 will not interfere with or engage the bend wire spring 72 in further assembling steps, as better shown in FIG. *2a*, which illustrates the position of the thin stalk 66 with respect to the spring 72. A thin retaining ring (not shown) is then inserted in the reduced diameter region 68 to secure the selector 60 on the handle 4.

In sequence, the activator 20 is placed on top of the driver 38 so that the second conical frictional side 42 nests in the first conical frictional side 24, and so that the first frictional surface 25 rests on the second frictional surface 43.

Bearing balls 28 are then placed in each semi-cell 26 of the second set of augmented semi-cells. This operation may preferably be made by a robotic mechanism, preferably computer driven, which may place the bearing balls in the proper positions, or otherwise by dipping into and then raising the assembly of the activator 20 and the driver 38 from a well of bearing balls, followed by light shaking in order to remove the excess of bearing balls. Similarly, a stream of bearing balls may be allowed to fall on to the cell side 22 of the activator, and then remove the excess of bearing balls and ensure that the rest are well arranged within the second set of augmented semi-cells 26. Placing the bearing balls one by one manually in the proper positions, is of course another alternative, among many.

After the above operation, the head 6 is placed on top of the activator 20, so that the first set of augmented semi-cells 12 is matched with the second set of augmented semi-cells 26, one being the mirror image of the other, and each pair of matching semi-cells form a full cell 27 containing a bearing ball 28. The size of the balls is preferably selected such that even before the semi-cells have been displaced during the operation of the tool, as better described hereinbelow, there is still a small gap 21 between the activator 20 and the head 6 of the handle 4. The orientation of the handle 4 is chosen in a manner that the perforation 7 of the handle 4 is positioned on top of the biasing portion 74 of the bent wire spring 72 and the elongated slot 34 of the guide 32.

Figure 4:
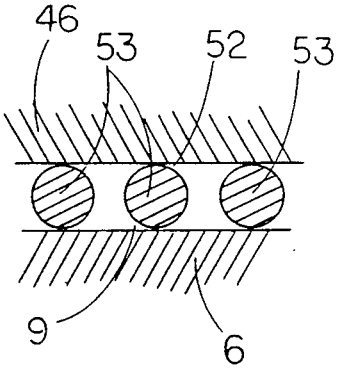
FIG. 4 illustrates an unfolded cross section of a typical ball bearing.

The first circular groove 9 is then filled with a second set of bearing balls 53, preferably of the same size as the first set of bearing balls 28, using similar techniques as described above. Subsequently, the sleeve 50 of the restrictor 46 is passed through the first center bore 16 and the second center bore 30, so that the second circular groove 52 rests on the second set of bearing balls 53. In this arrangement, the two circular grooves 9 and 53 along with the second set of bearing balls 53 form a complete ball bearing, a fractional unfolded cross-sectional view of which is illustrated in FIG. 4.

Finally, the bolt 54 is inserted through the V-shaped bore 48, and threaded on the threaded bore 44, completing the assembling process.

In operation of this embodiment, a socket having a desired size is secured in the socket driving stem 40 of the driver 38. The selector 60 is then turned in one of four positions, which influences the biasing status of the activator 20 with respect to the head 6 of the handle 4.

If the knob 62 is turned in a manner that the thin stalk 66 is directed toward the head 6, the thin stalk 66 does not touch the bent wire spring 72 and no biasing through the spring 72 occurs. The relative positions of the spring 72 and the thin stalk 66 are illustrated in FIG. *2a*. With the knob 62 in this position, when the socket is engaged on an item to be turned, such as a nut for example, and the operator turns the handle in one or the opposite direction, the activator 20 tends to stay stationary, since it rests on the driver 38, and the first and second conical frictional surfaces 25 and 43, respectively, are in contact, thus providing adequate friction to oppose movement of the activator 20 with respect to the driver 38. As the handle 4 continues moving, the first set of augmented semi-cells 12 is displaced with respect to the second set of augmented semi-cells 26, causing the first set of bearing balls to exert a force pushing the activator 20 away from the head 6, and towards the driver 38. Since the distance between the head 6 and the driver 38 is restrained by the restrictor 46 through the bolt 54 (which is threadably connected to the driver 38), the force exerted by the bearing balls 28 to the activator 20 results in increased frictional locking of the activator 20 onto the driver 38 through their respective first and second conical frictional surfaces 25 and 43. The higher the force the operator applies on the handle the higher the pressure applied form one frictional surface to the other, and therefore the higher the frictional locking of the activator 20 to the driver 38. Additionally, at the same time, the bearing balls 28 jam the pair of augmented semi-cells 12 and 26, thus temporarily locking the head 6 and the handle 4 to the activator 20. The final result of these actions is temporary but secure locking of the handle 4 to the driver 38 through the activator 20. Thus, the operator may turn the item, such as a nut for example, through the socket attached to the driver.

If the operator changes direction of turning the handle, the same sequence of events takes place, and the tool 2 is also locked in this new direction. It is now clear that in the absence of biasing of the activator 20 with respect to the head 6 of the handle 4, results in locking the driver 38 with respect to the handle 4 in both directions. In moving from one locking position to the opposite locking position, there is involved some idle rotational movement of the handle with respect to the driver. However, this is inconsequential for the purposes of this invention, since the idle movement may be substantially eliminated completely by biasing the activator 20 with respect to the head 6 in one or the opposite direction, as it will be detailed hereinbelow.

If the knob 62 is turned in a manner that the thin stalk 66 is directed away from the head 6, the thin stalk 66 stays in the biasing portion 74, thus appending the activator 20 onto the handle 4 through the bent wire spring 72. At this position, the first and second sets of augmented semi-cells 12 and 26 are aligned with respect to each other. The relative positions of the spring 72 and the thin stalk 66 are illustrated in FIG. *2b*. With the knob 62 in this position, when the socket is engaged on an item to be turned, such as a nut for example, and the operator turns the handle in one or the opposite direction, the activator 20 follows the handle as being appended from it, provided that the spring 72 is adequately strong to overcome any frictional forces tending to oppose rotational movement of the activator 20 along with the rotational movement of the handle 4. This condition, which circumvents displacement of the 2 sets of the augmented semi-cells 12 and 26 with respect to each other, results in substantially free movement of the handle 4 with respect to the driver 38, and the tool 2 is unlocked in both directions.

Figure 2C:
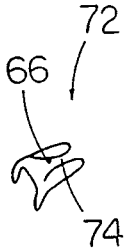
Figure 2D:
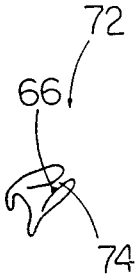
Figure 3:
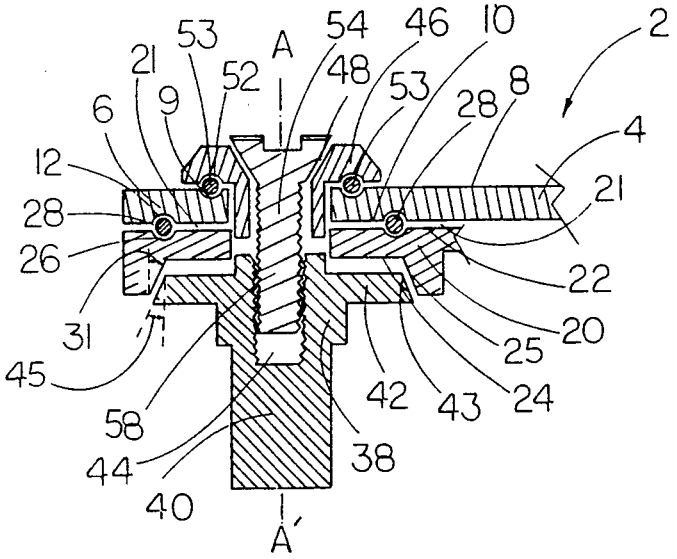
FIG. 3 is a schematic representation of a cross section of the assembled ratchet shown in parts in FIG. 1, except that the selector part is not shown for simplicity purposes.

If the knob 62 is turned in a manner that the thin stalk 66 is aimed in a direction about 90 degrees different from the directions described in the two previous cases, the activator 20 is biased to rotate somewhat with respect to the handle, so as to cause displacement of the two sets of the augmented semi-cells with respect to each other, resulting in forcing the activator 20 toward the driver 38 and preliminary engagement of the first and second frictional surfaces 25 and 43. Any attempt of an operator to turn the handle 4 in a direction favoring the biasing forces, fortifies the tendency of the matched augmented semi-cells 12 and 26 to be displaced further with respect to each other, and for the same reasons as described above, it increases the frictional locking of the driver 38 to the activator 20 and in turn to the handle 4. If the operator pulls the handle 4 in a direction against the biasing forces, the sets of the matching augmented semi-cells 12 and 26 tend to realign themselves away from the displacement positions, and free the diver 38 from the activator 20, and in turn from the handle 4, thus allowing free rotational movement of the handle 4 with respect to driver 38. The relative positions of the spring 72 and the thin stalk 66 in this case are illustrated in FIGS. 2*c* and 2*d*. In the case of FIG. 2*c* the activator 20 as been biased in a certain direction with respect to the handle 4, while in the case of FIG. 2*c*, the activator 20 as been biased in the opposite direction with respect to the handle 4.

It may be seen from the above, that biasing of the activator with respect to the handle or base, results in biasing the augmented semi-cells of each pair. It may also be seen that the toothless rachet or the clutch mechanisms, depending on the way the augmented semi-cells of each pair are biased, follow a condition selected from the group consisting of locking the base with respect to the driver in one direction, locking the base with respect to the driver in an opposite direction, locking the base with respect to the driver in both directions, maintaining the base unlocked with respect to the driver in both directions, and a combination thereof.

Due to the fact that biasing of the activator 20 with respect to the handle 4 brings substantially the tool in a locking position (in the direction favoring the biasing forces) no substantial further movement of the handle 4 with respect to the driver 38 is needed to effect locking. In a prototype made according to this invention, a rotation of only 0.28 degree was adequate to effect locking of the biased tool. This is a vast improvement over conventional ratchet mechanisms which typically require a minimum of 15 to 20 degrees of handle rotation in order to operate.

The characteristic of the mechanisms of the present invention to only require almost infinitesimal rotational movement in order to operate, combined with their simplicity, is a unique feature allowing high diversity of applications.

Thus, this mechanism of clutching action, according to this invention, between the activator and the driver, which finally results in locking action of the driver with the handle may take different forms depending on the application it is being used for. The handle portion of the tool may become a base for supporting different structural configurations, and thus take different forms and shapes, having no resemblance to a conventional handle.

For example, the handle 4 may be reduced to just the head 6 portion and become a base for supporting a socket with the back part of the socket pointing away from the head and having a cavity of the type which can accept and engage with a socket driving stem, the socket having A–A′ as an axis of symmetry. Such a device may be used in combination with a standard non-rotational socket driver to transform the non-rotational socket driver to a rotational one having the characteristics of a toothless rachet according to this invention. Use of such a device in combination with a torque wrench would present similar advantages. The operation of this embodiment is very similar to the operation of the embodiment described above in detail, with the difference that the socket driving stem of the standard non-rotational socket driver is inserted into the above mentioned cavity in order to form a system operating as the single tool 2 of the previous embodiment.

Also, the clutch mechanisms as described above may further comprise pulsating means pivotally connected to the base 4 for providing oscillatory motion to the base around the center axis A–A′. The pulsating means could be any oscillation providing means, but preferably they are of electromagnetic nature, since this type of energy is readily available to electrically operated tools. Since the smaller the amplitude of the oscillations the simpler the structure of the transducer of electric to mechanical/ oscillatory motion is, the devices of this invention, which require almost infinitesimal movement to operate, are most suitable for changing the oscillatory motion on the base 4 to rotational motion on the driver 38. The oscillatory motion of the base may be characterized by an oscillation angle, which is the angle that the base turns around the axis A–A′ in each oscillation. It is important that the angle has an effective value to translate the oscillatory motion of the base to rotational motion on the driver for the tool to be operational. The effective value depends on many factors, some of which are the quality of the tool, the nature and modulus of the materials used, the loads involved, and the like. As aforementioned, in a prototype made according to this invention, a rotation of only 0.28 degree was adequate to effect locking of the handle or base to the driver. Preferably, the oscillatory angle has a value in the range of 0.5–10 degrees. In operation, the oscillatory means cause the base to oscillate back and forth. Depending on the direction of biasing of the activator with respect to the base, one of the two half-oscillations (back or forth) will cause the driver 38 to rotate in the direction favoring the biasing forces, while during the other half oscillation, the driver will remain idle. Thus, as the oscillations continue to take place, the driver 38 will proceed rotating.

The description of the above preferred embodiments was presented only to exemplify some aspects of the instant invention and it should not be construed as limiting the scope of the invention.

What is claimed is:

1. A toothless ratchet tool comprising in combination an assembly of:

a handle ending to a head, the head having an upper side and a lower side opposite the upper side, the lower side comprising a first set of augmented semi-cells disposed around a center axis passing through a central point of the head, and being perpendicular to the lower and upper sides;

an activator disposed toward the lower side of the head and pivoted around the center axis, the activator having a cell side and a first conical frictional side opposite the cell-side, the cell side comprising a second set of augmented semi-cells commensurate to the first set of augmented semi-cells of the lower side of the head, thus forming pairs of augmented semi-cells;

a plurality of bearing balls, one ball contained in and co-acting with each pair of semi-cells;

a driver being turnable around the center axis and disposed under the activator in a manner to place the activator between the driver and the head of the handle, the driver having a socket driving side and a second conical frictional side commensurate to and adaptable to engage with the first conical frictional side; and means for rotatably connecting the driver and the head of the handle, and at such distance from each other, that when the augmented semi-cells of each pair are caused to be displaced with respect to each other, the activator is pushed toward the driver causing the first and the second frictional side to firmly engage and lock the driver in one direction with respect to the handle.

2. A toothless ratchet tool as defined in claim 1, wherein the augmented semi-cells are equidistantly disposed from the center axis and also equidistantly disposed from each other.

3. A toothless ratchet tool as defined in claim 1, wherein the means for rotatably connecting the driver and the head of the handle comprise a ball bearing formed between an extension of the driver and the upper side of the head.

4. A toothless ratchet tool as defined in claim 1, wherein the first conical frictional side comprises a configuration corresponding to the inside surface of a cone, and the second conical frictional side comprises a configuration corresponding to the outside surface of a cone.

5. A toothless ratchet tool as defined in claim 1, further comprising means for biasing the augmented semi-cells of each pair in a position causing the tool to follow a condition selected from the group consisting of locking the handle with respect to the driver in one direction, locking the handle with respect to the driver in an opposite direction, locking the handle with respect to the driver in both directions, maintaining the handle unlocked with respect to the driver in both direction, and a combination thereof.

6. A toothless ratchet tool as defined in claim 5, wherein the means for selectively biasing the augmented semi-cells comprise a spring.

7. A toothless ratchet tool as defined in claim 5, wherein the augmented semi-cells are equidistantly disposed from the center axis and also equidistantly disposed from each other.

8. A toothless ratchet tool as defined in claim 5, wherein the means for rotatably connecting the driver and the head of the handle comprise a ball bearing formed between an extension of the driver and the upper side of the head.

9. A toothless ratchet tool as defined in claim 5, wherein the first conical frictional side and the second conical frictional side exhibit a cone angle in the range of 10–40 degrees.

10. A clutch mechanism comprising in combination an assembly of:

a base having a head, the head having an upper side and a lower side opposite the upper side, the lower side comprising a first set of augmented semi-cells disposed around a center axis passing through a central point of the head, and being perpendicular to the lower and upper sides;

an activator disposed toward the lower side of the head and pivoted around the center axis, the activator having a cell side and a first conical frictional side opposite the cell-side, the cell side comprising a second set of augmented semi-cells commensurate to the first set of augmented semi-cells of the lower side of the head, thus forming pairs of augmented semi-cells; a plurality of bearing balls, one ball contained in and co-acting with each pair of semi-cells;

a driver being turnable around the center axis and disposed under the activator in a manner to place the activator between the driver and the head of the base, the driver having a driving side and a second conical frictional side commensurate to and adaptable to engage with the first conical frictional side; and means for rotatably connecting the driver and the head of the base, and at such distance from each other, that when the augmented semi-cells of each pair are caused to be displaced with respect to each other, the activator is pushed toward the driver causing the first and the second frictional sides to firmly engage and lock the driver in one direction with respect to the base.

11. A clutch mechanism as defined in claim 10, wherein the augmented semi-cells are equidistantly disposed from the center axis and also equidistantly disposed from each other.

12. A clutch mechanism as defined in claim 10, wherein the means for rotatably connecting the driver and the head of the base comprise a ball bearing formed between an extension of the driver and the upper side of the head.

13. A clutch mechanism as defined in claim 10, wherein the first conical frictional side comprises a configuration corresponding to the inside surface of a cone, and the second conical frictional side comprises a configuration corresponding to the outside surface of a cone.

14. A clutch mechanism as defined in claim 10, further comprising means for biasing the augmented semi-cells of each pair in a position causing the tool to follow a condition selected from the group consisting of locking the base with respect to the driver in one direction, locking the base with respect to the driver in an opposite direction, locking the base with respect to the driver in both directions, maintaining the base unlocked with respect to the driver in both direction, and a combination thereof.

15. A clutch mechanism as defined in claim 14, wherein the means for selectively biasing the augmented semi-cells comprise a spring.

16. A clutch mechanism as defined in claim 14, wherein the augmented semi-cells are equidistantly disposed from the center axis and also equidistantly disposed from each other.

17. A clutch mechanism as defined in claim 14, wherein the means for rotatably connecting the driver and the head of the handle comprise a ball bearing formed between an extension of the driver and the upper side of the head.

18. A clutch mechanism as defined in claim 14, wherein the first conical frictional side and the second conical frictional side exhibit a cone angle in the range of 10–40 degrees.

19. A clutch mechanism as defined in claim 14, further comprising pulsating means pivotally connected to the base for providing oscillatory motion to the base, the oscillatory motion characterized by an oscillation angle having an effective value to translate the oscillatory motion of the base to rotational motion on the driver.

20. A clutch mechanism as defined in claim 10, further comprising a socket supported on the base, the socket having a cavity of the type which can accept and engage with a socket driving stem, the socket having the center axis as an axis of symmetry.

* * * * *